US006080027A

United States Patent [19]

Rodemann

[11] Patent Number: 6,080,027

[45] Date of Patent: Jun. 27, 2000

[54] FLOTATION DEVICE

[76] Inventor: Will Rodemann, 42 Harbor La. P.O. Box 124, Round Pond, Me. 04564

[21] Appl. No.: 09/175,379

[22] Filed: Oct. 19, 1998

[51] Int. Cl.[7] ..... B63B 35/58

[52] U.S. Cl. ..... 441/41; 441/42; 441/38; 441/80

[58] Field of Search ..... 441/81, 40, 41, 441/42, 92, 67, 69, 73, 80, 125; 114/360, 123, 54, 345

[56] References Cited

U.S. PATENT DOCUMENTS

| | | | |
|---|---|---|---|
| 831,891 | 9/1906 | Quarterman | 441/81 |
| 3,336,613 | 8/1967 | Wales | 441/42 |
| 4,355,987 | 10/1982 | Miller | 441/41 |
| 4,458,618 | 7/1984 | Tuffier | 114/68 |
| 4,635,581 | 1/1987 | Scheurer | 114/346 |
| 4,685,890 | 8/1987 | Edwards | 441/89 |
| 4,843,992 | 7/1989 | Babikian | 114/69 |
| 5,284,453 | 2/1994 | Kun | 441/42 |
| 5,411,425 | 5/1995 | Rinker | 441/130 |
| 5,516,233 | 5/1996 | Courtney | 405/186 |

FOREIGN PATENT DOCUMENTS

| | | | |
|---|---|---|---|
| 1332634 | 10/1973 | United Kingdom | 7/8 |

*Primary Examiner*—Stephen Avila
*Attorney, Agent, or Firm*—Patrick J. Walsh

[57] ABSTRACT

Compact and light weight deployable flotation devices with improved elasticity, tensile strength, shear strength, and puncture resistance using higher quality materials and sequencing of layers of polymer coating with greater mechanical strength in outer layers, and improved impermeability to gas leakage from within. The flotation devices are folded in containers with the containers having an integral gas supply cannister for use in a vehicle or vessel and for portability. The flotation devices are deployed by inflation by means of mechanical pull cord, automatically by float switches, hydrostatic release, electronic panic buttons, or switches used with a pyrotechnic release valve mechanism, or by pyrotechnic inflators. Restraining mechanisms form part of inflatable bag construction for permanent mounting in a vehicle or vessel. A protective cover enshrouds the inflatable bag and its integral restraining mechanism, the shroud being able to expand at the end of bag inflation.

15 Claims, 8 Drawing Sheets

FLOTATION DEVICE

BACKGROUND OF THE INVENTION

The present invention relates to flotation devices and particularly to improvements for devices of this kind.

The limitations of common techniques for providing flotation can be summarized as:

1. Fixed flotation such as foam takes up too much space and is not practical except in the lightest of vessels.
2. Air and watertight compartments are expensive and practical only in the largest of ships, and even then a major flooding of compartments will sink the vessel unless there is another means of internal flotation to resist flooding.
3. Pumps normally do not have the capacity to stay ahead of a flooding condition.
4. Life rafts and personal flotation devices save lives. However, more than personal flotation is needed for any length of time and for survival in heavy weather. In addition, life rafts and personal flotation present a much smaller target for a rescue team than the original vessel, and the original vessel also contains drinking water, a food supply, navigational devices and communications equipment which are not ordinarily transferable to a life raft.
5. Many existing flotation devices require deployment on the outside of a vessel, or van or snowmobile travelling over a frozen lake or stream, subjecting the device to damage or otherwise diminishing its practical use for flotation.
6. Devices fabricated of rubber or rubberized fabric are too heavy and often take up too much space for convenient use for flotation or as spill containment devices.

U.S. Pat. No. 4,887,541 discloses onboard deployable flotation devices placed in strategic positions throughout a vessel to provide positive buoyancy so as to prevent sinking of the vessel. The devices comprise multiple ply construction including inner bag with outer protective cover fitted into portable carryalls or secured in deflated condition to the hull of a vessel. The flotation devices may be located at a point separate from their means of inflation and several flotation devices can be inflated by a common inflation system. Flotation devices of this kind are particularly suited for fishing boats, motorboats and sailboats.

The present invention provides improvements in the field of deployable flotation devices for marine vessels, lift bags for marine salvage, for vehicles operating on the surface of frozen water, and also for spill containment of environmental hazards.

SUMMARY OF THE INVENTION

The present invention provides improvements in the materials and construction of the deployable flotation devices of the '541 patent with compactness and light weight remaining as distinguishing characteristics. In accordance with the invention, inflatable bags are folded down to even smaller size while retaining strength and puncture resistance.

Elasticity, tensile strength, shear strength, and puncture resistance are improved by use of higher quality materials and the sequencing of layers of polymer coating with resultant greater mechanical strength in outer layers, and improved impermeability to gas leakage from within. These improvements enable use in some applications of a single layer of material, further reducing storage space required before deployment, as well as reducing the weight of the completed product.

The flotation devices are usually inflated with carbon dioxide, carbon dioxide mixed with nitrogen, air, hybrid combination of gas, or with a lighter-than-air gas. The supply of gas may be remote from flotation devices or the devices may be packaged with a supply of inflating gas. The flotation devices are folded in hard-sided or soft-sided containers with the containers having an integral gas supply cannister for easy-to-use, convenient storage in a vehicle or vessel and for portability as needed to another vehicle or vessel. Alternatively, the devices may be permanently mounted in a vehicle or vessel with remote gas supply during fitting out or by retrofit.

The flotation devices are deployed by inflation by means of mechanical pull cord, automatically by float switches of various types, hydrostatic release, electronic panic buttons, or switches used with a pyrotechnic release valve mechanism, or by pyrotechnic inflators.

Another aspect of the invention provides restraining mechanisms forming an integral part of inflatable bag construction. Alternatively, the restraining mechanisms connect to the inflatable bag on novel tabs of increased strength forming an integral part of the inflatable bag along one or more of its sides. The tabs provide ready means for permanent mounting, utilizing heavy duty bolts or clamps for attachment to a vehicle or vessel.

In still another aspect of the invention, a protective cover enshrouds the inflatable bag and its integral restraining mechanism, the shroud being a strong webbing or net or a smooth elastic material of a size to expand at the end of bag inflation. The shroud provides mechanical protection for the inflatable bag particularly in situations involving towing a raised object to shore through seaweed, floating debris, or other obstacles in the water.

OBJECTS OF THE INVENTION

An object of the invention is to provide an inflatable bag in a variety of shapes with single wall construction comprising woven, knitted, laid, or deposited outer layer protective cover with an inside layer or multiple layers of thermoplastic film.

Another object of the invention is to provide inflatable bags constructed of two pieces of thermoplastic coated material sealed around the edges resulting in various shapes upon inflation.

Another object of the invention is to provide inflatable bags that are portable in use or alternatively mounted as engineered or customized systems with a gas supply for inflation and means for activating inflation of the bags.

Another object of the invention is to provide means for activating inflating mechanisms including pull cords, float switches, hydrostatic releases, or electronic panic buttons with a pyrotechnic release valve mechanism.

Another object of the invention is to provide single wide flat-sealed inflatable bags and a single wide flat-sealed reinforced edge of sufficient strength to allow its use in attaching the inflatable bag to a vehicle or vessel for flotation.

Another object of the invention is to provide a restraining mechanism integral with inflatable bags comprising a web strap or woven netting to be fastened as low as practicable to a sinking or sunken object.

Another object of the invention is to provide a restraining mechanism integral with inflatable bags comprising straps or netting loosely enclosing the bags to be fastened to a sinking or sunken object.

Another object of the invention is to provide inflatable bags with a restraining mechanism integrally mounted to a reinforcing strip, tabs, straps, or netting to be fastened to structural members of a vessel or to a sinking or sunken object.

Another object of the invention is to provide a protective cover for enshrouding inflatable bags and their integral restraining mechanisms, the shroud being a strong webbing or net or a smooth elastic material of a size to expand at the end of bag inflation and to provide mechanical protection for inflatable bags.

Another object of the invention is to provide an inflatable buoyancy device comprising outer and inner sealed inflatable bags.

Another object of the invention is to provide a double-wall, double sealed inflatable within an inflatable.

Another object of the invention is to provide an array of inlet, topping off, and pressure relief valves for accommodating gas flow to inner bags without leakage.

Another object of the invention is to provide inflatable devices mounted in portable pouch enclosures integral with inflatable bags and their restraining mechanisms with the pouches having openings such that the enclosure bursts open upon inflation of the bag.

Another object of the invention is to provide pouch enclosures of elastic cloth to expand with inflation of flotation bags.

Another object of the invention is to provide inflatable devices for attachment to commercially available hardware including rings and shackles so as to float or lift submerged objects.

Other and further objects of the invention will become apparent with an understanding of the following detailed description of the invention or upon employment of the invention in practice.

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

The present invention comprises improvements in inflatable devices suitable for deployment inside or outside a boat or other marine vessel, for attachment to a vehicle or other object in water or to a vehicle or object that may enter a body of water as through breaking ice, or which may already be submerged.

Figure 1:
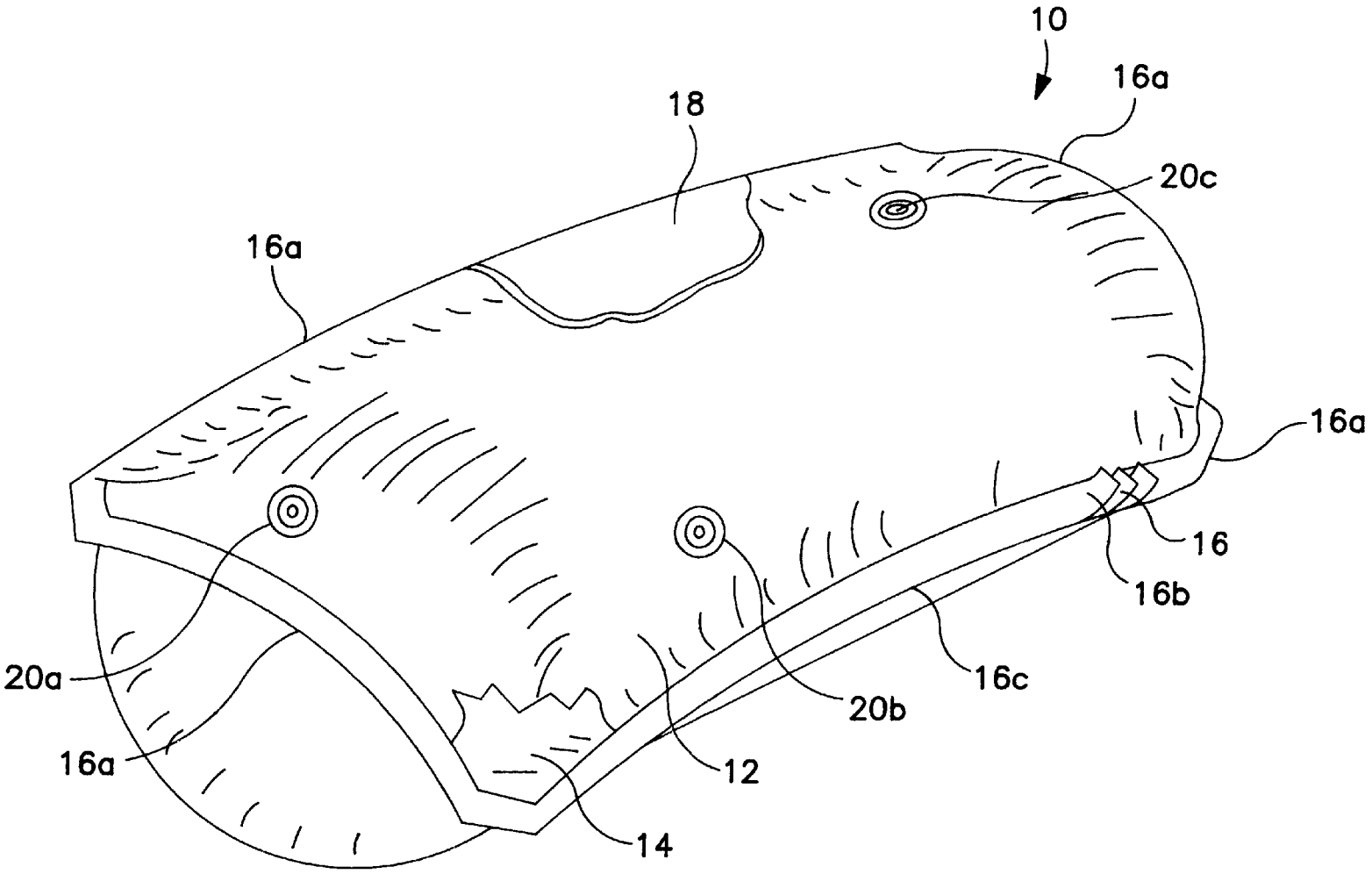
FIG. 1 illustrates an inflatable bag of single wall construction with coated inner surface for impermeability to inflating gas and with outer puncture-resistant surface.

Referring to the drawing, FIG. 1 illustrates an inflatable bag 10 according to the invention comprising a sole layer of material, i.e., a single wall construction of a woven, knitted, laid or deposited outer layer 12 of suitable weight covered on its inner surface 14 with a deposited layer of suitable thickness of thermoplastic material, including but not limited to films of polyurethane. The outer surface of the outer layer may also be coated with a deposited layer of thermoplastic film forming a protective cover for improved puncture and tear resistance.

The outer layer 12 utilizes material such as rip-stop nylon, cordura, and ballistic fabrics with heavier weights being used as flotation lift bags in salvage operations, as well as for mounting on the exterior of vehicles travelling over frozen lakes. The weaves are in various weights ranging from 200 to over 1000 denier.

The polyurethane covering for the inner surface 14 of the outer layer is applied either as a film liner or as a surface coating. The innermost coating is the most pliable and must be as impermeable to inflating gas as possible.

The bag of FIG. 1 includes an integral reinforced edge 16 of several heavy duty layers of material, sealed together to form a heavy tab 16*a* for bolting or otherwise fastening the inflatable to a boat, vehicle, etc. These tabs 16*a* are preferably used on additional sides of the inflatable bag, depending on application.

In single wall bag construction of FIG. 1, the edge seals are accomplished with one pass application of heat to form a sealed tab of 16*a* substantial width. Alternatively, the tab seals may be accomplished in two passes applied to one side 16*b* then to the other side 16*c* of the tab to form a double seal.

The double seal of the tab flanges is also accomplished in one pass using a "U" shaped application of heat simultaneously to both sides of the tab.

For each sealing technique, there results a double sealed tab flange.

If desired, the inflatable bag of FIG. 1 may be enclosed within an outer protective cover 18 sewn, heat sealed, or fastened by cements or glues to the inflatable bag. The cover protects the inflatable bag from puncture and other damage without the ability to contain an inflating gas. In applying a protective cover, the outer surface of the inflatable bag is covered with a sufficient thickness of thermoplastic material such as polyurethane, PVC, and the like so that a heat sealing method will embed the protective cover in the outer surface of the inflatable bag.

Inflation of the bag 10 is achieved by means of valves 20*a–c* which typically include an inlet or inlet check valve, a pressure relief valve and a topping off valve.

Figure 2:
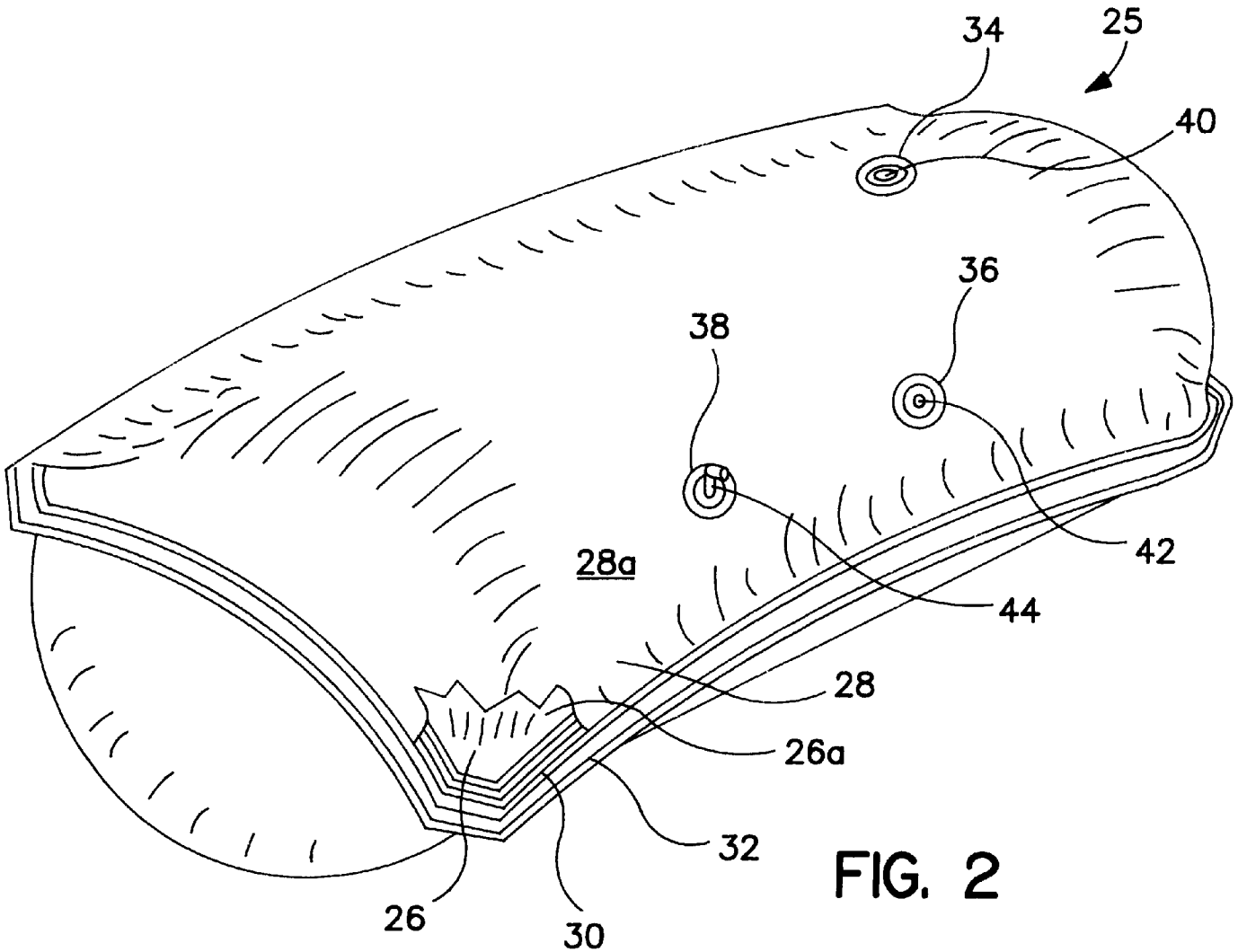
FIG. 2 is an assembly view of an inflatable bag according to the invention comprising inner buoyancy and outer buoyancy bags.

The flotation device 25 of FIG. 2 comprises an inner buoyancy bag 26 and an outer buoyancy bag 28. The peripheral flange or tabs 30, 32 of inner and outer bags are heat sealed in a single bar seal, flat seal or double bar seal using heat sealing tools, high frequency (ultrasonic) heat sealing methods, as well as other sealing methods such as cements or glues. The "bag-within-a-bag" flotation device

25 provides an effective double walled flotation device employed individually or in combination with similar flotation devices to provide adequate lift for submerged objects, and also to maintain an object in a floating condition.

The "bag-within-a-bag" is formed as follows. The inner bag 26 (FIGS. 2–4) is dimensioned to fit tightly within the outer bag 28. The upper 26*a*, 28*a* and lower walls of the inner (not shown) and outer 28*b* bags are individually assembled with a portion of the perimeter of their peripheral flanges 30, 32 sealed leaving an opening through an unsealed portion 30*a*, 32*a* of the flanges of both inner and outer bags. Next, the inner bag (still having an opening through the unsealed portion of its peripheral flange) is folded and inserted through the opening or unsealed portion of the flange of the outer bag. The inner bag is then unfolded or spread within the outer bag. Aligned valve receiving openings 34, 36, 38 are then cut through the adjacent walls of the inner and outer bags for fitting bag inflating valves 40, 42, and 44.

Figure 3:
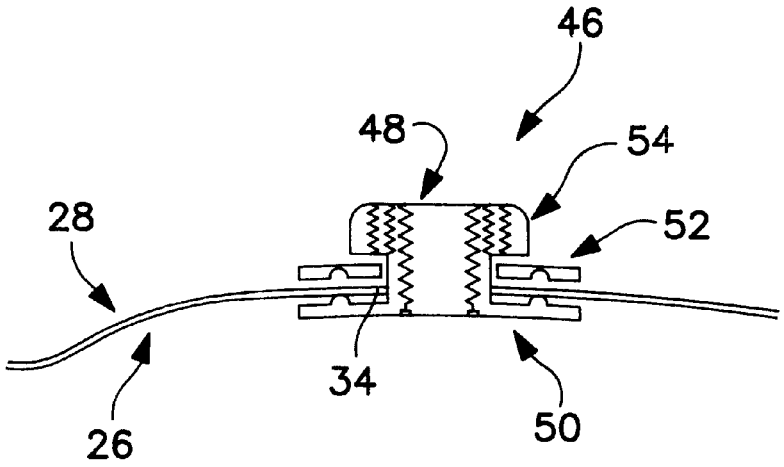
FIG. 3 is a fragmentary section view of a valve mounting in the inner and outer walls of a flotation device.
Figure 4:
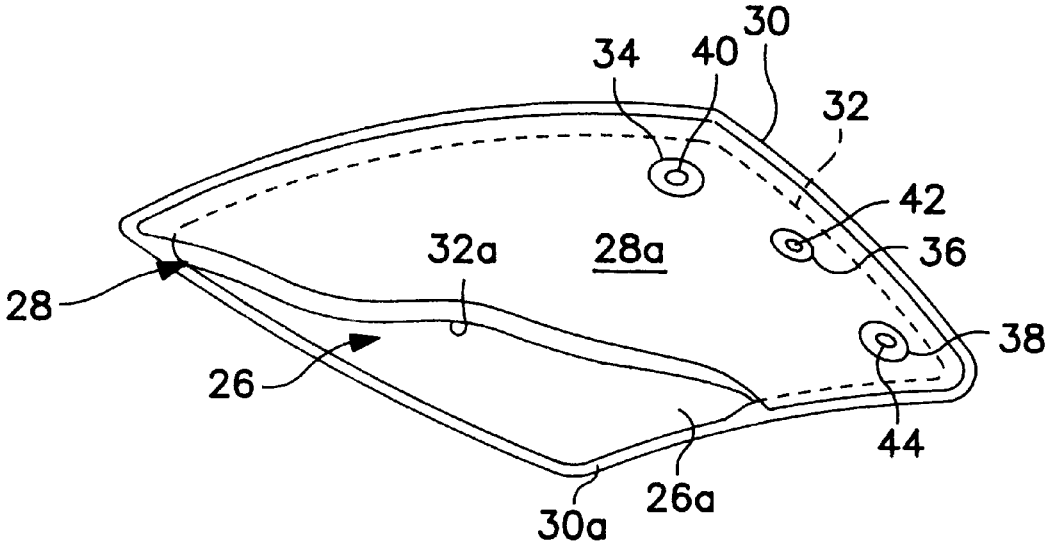
FIG. 4 illustrates a flotation device with inner and outer bags as they are assembled.

The valve receiving components 46 shown in FIG. 3 include a threaded receptacle 48 with inner flange 50 set into the opening 34 in the bag walls, an outer flange ring 52 and a tightening nut 54 for securing the assembly. If desired, rubber gaskets may be used between flanges and outer and inner bag walls. The threaded receptacle accepts an inlet check valve, or a pressure relief valve or a topping off valve. The valves are inserted with their flanges sealed to gas tightness against the bag wall.

Finally, the openings defined by the unsealed portions 30*a*, 32*a* of the flanges of the inner and outer bags are sealed to complete bag construction.

The term "double wall" refers to the use of two separate layers of thermoplastic material to form inner and outer bag segments of a flotation device, either of which bags retains the inflation gas for an extra measure of safety and reliability in the inflatables thus constructed.

In the "bag-within-a-bag" inflatable devices the bags are sealed completely with the lower half segment of the flange introduced inside the inner bag, and the outer half segment turned into place for final assembly.

The "bag-within-a-bag" components of FIG. 2 may be formed in other possible shapes including cylinders with closed end body panels, cubes with closed ends, triangular or trapezoidal cushion shapes or teardrop shaped inflatables to facilitate attachment to a submerged object.

Figure 5:
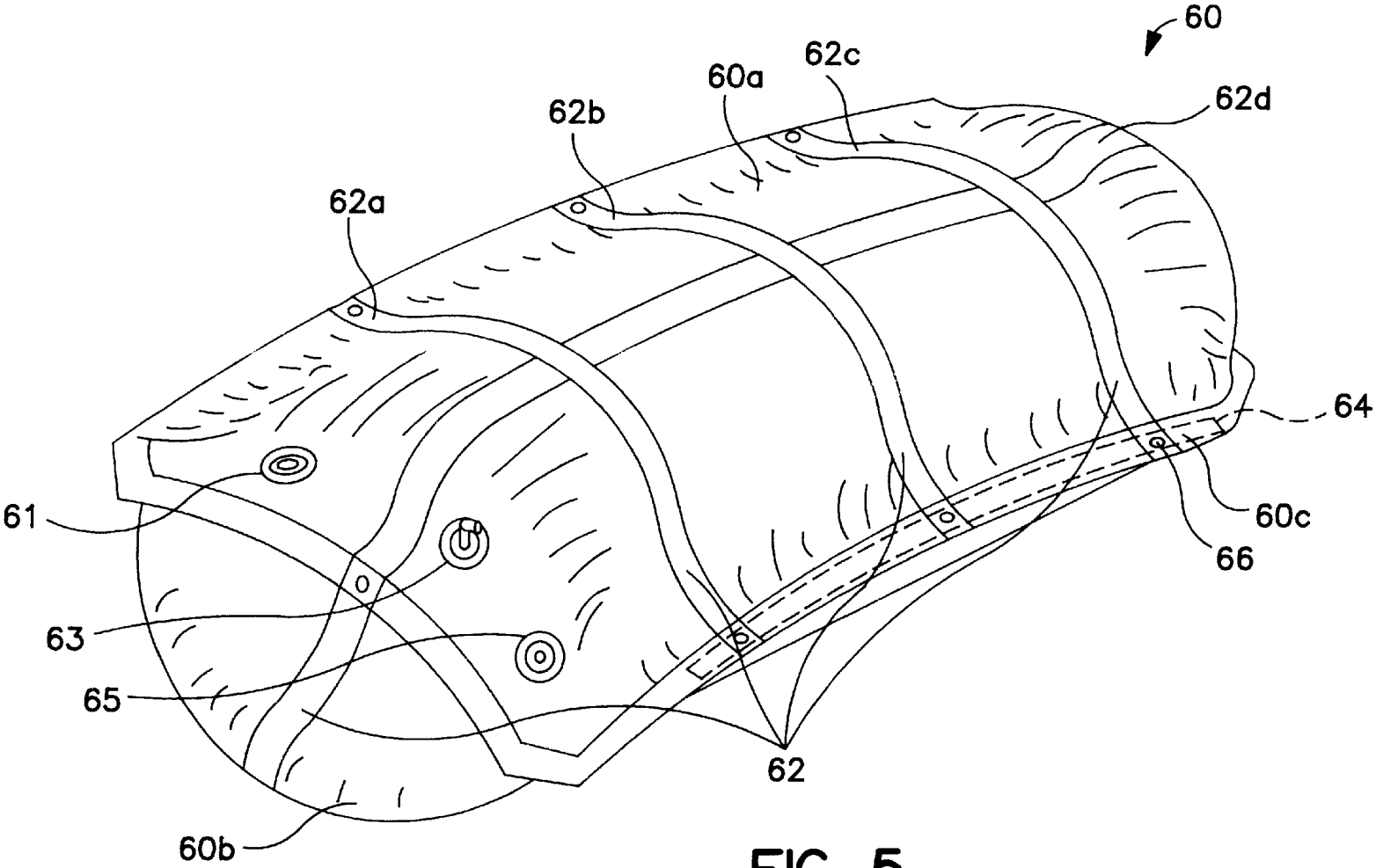
FIG. 5 is illustrated an inflatable bag with integral mounting straps.

The inflatable bag 60 illustrated in FIG. 5 comprises upper 60*a* and lower 60*b* walls sealed along a peripheral flange 60*c* defining an interior gas receiving interior. Web straps 62 are fastened to the flanges of the inflated bag with a plurality, preferably three, straps 62*a–c* across and a longitudinal strap 62*d*. The straps provide a restraining mechanism to hold the inflatable in place in a boat vehicle, or an object to be lifted or floated in water. The attachment of the inflatable bag may be further strengthened by means of one or more stiff metal bars 64 to sandwich the strip tab, with the metal bars secured in place by heavy duty bolts 66 or a clamping mechanism.

Figure 6:
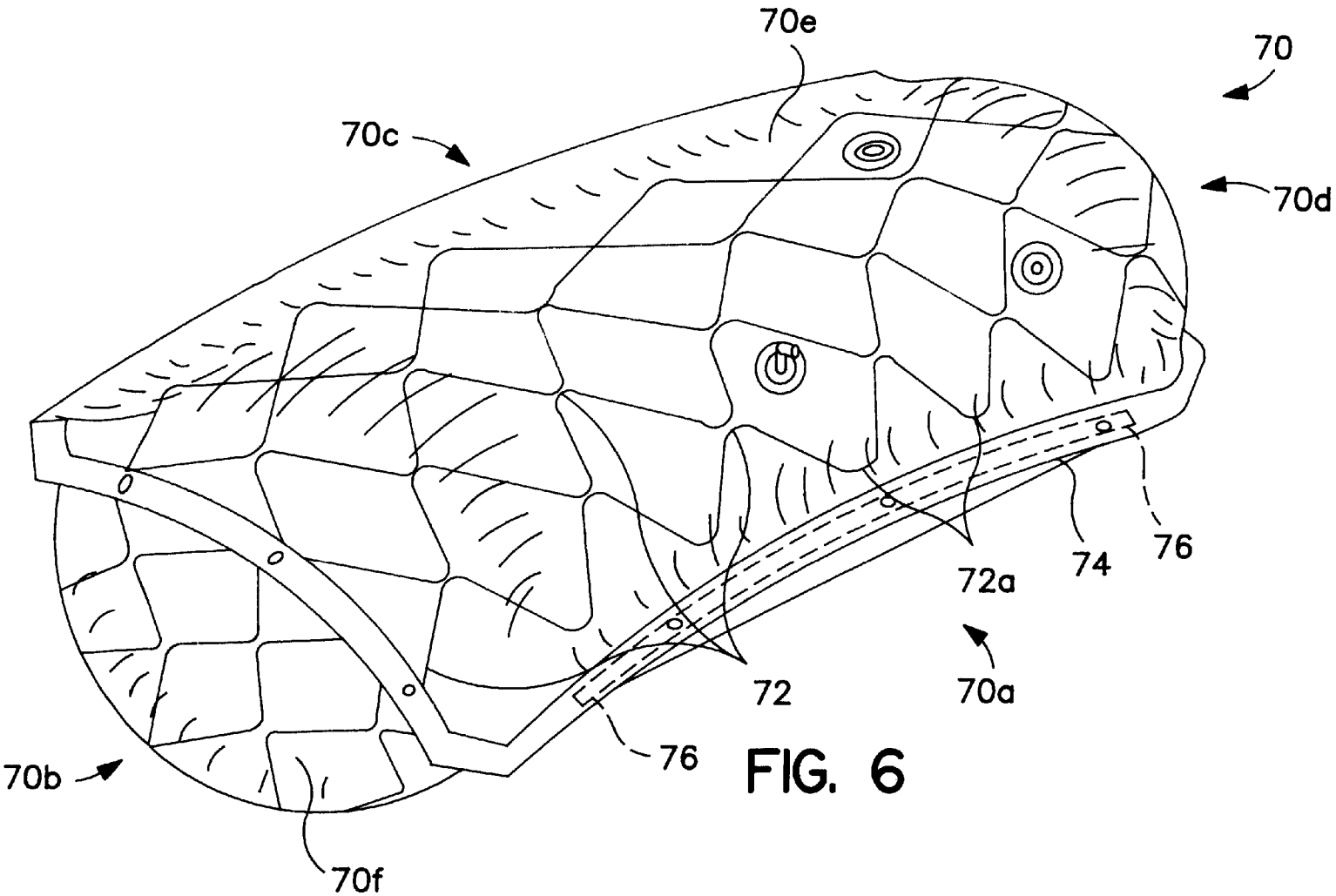
FIG. 6 illustrates an inflatable bag with heavy duty netting.

The inflatable bag 70 shown in FIG. 6 is fitted with a restraining net 72 preferably woven of polypropylene fibers and rope, or woven or braided line, or of commercially available cargo net of sufficient strength. The net restraining mechanism gathers and fastens a margin 72*a* of the net along one or more edges 70*a–d* of the bag. A reinforced strip tab 74 may be used with the net fastened thereby using rigid metal bar stock 76 to sandwich the net and the reinforcing strip tab 74, the resulting section being bolted or clamped at 76 in place to the object being floated.

In another form of restraining web construction as an integral part of the inflatable bag, a network of woven webbing is constructed with webs encircling the bag, grommeted or otherwise fastened at sealed edges, and bolted at the bottom with heavy duty clamps through the webbing and reinforced bottom edge. The reinforced bottom edge includes several layers of high -Denier material sandwiched and sealed integral with the inflatable bag itself.

Alternatively, the restraining net may merely encompass the inflatable bag without being fastened to the bag. In this case, the netting is provided with a ring or shackle for connection to a load to be floated. The inflatable is free then to assume the most natural shape imposed by hydrostatic pressure at unusual depths.

As in the case of protective covers described above, the netting 72 may also be sealed into the outer walls 70*e*, 70*f* of the inflatable bag by coating the bag with a sufficient thickness of a thermoplastic material and heat sealing the web in the coated surface.

Figure 7:
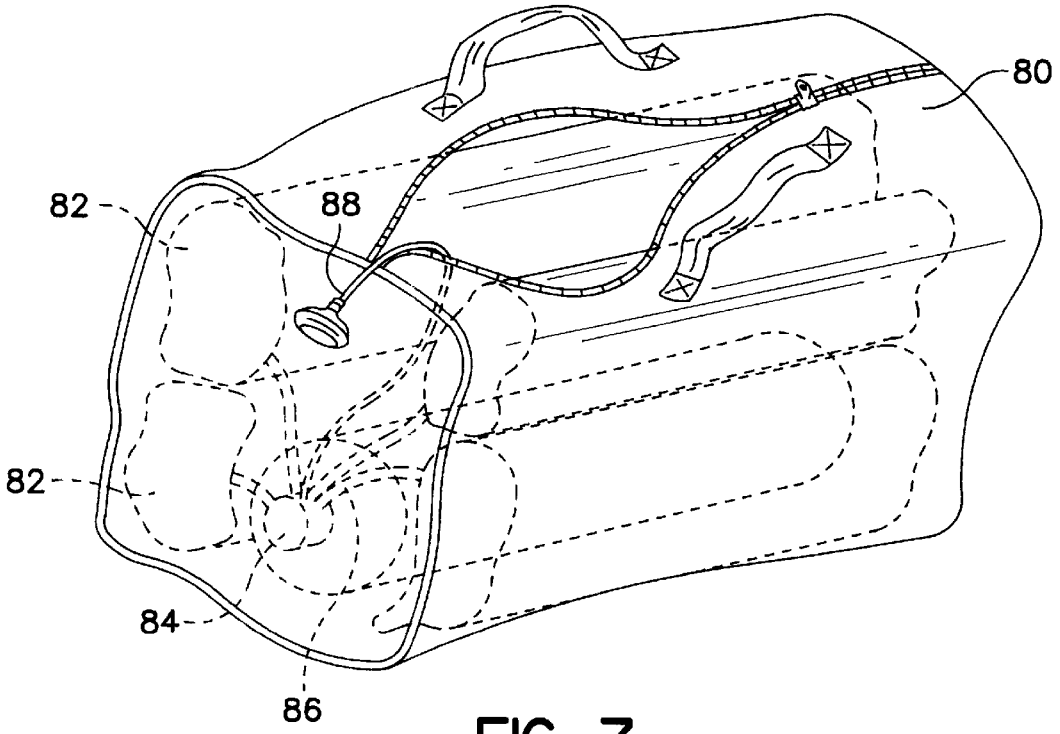
FIG. 7 illustrates a portable inflatable device for application to a boat including a plurality of folded inflatable bags.

A carryall soft valise 80 is shown in FIG. 7 for containing an entire floatation system comprising several inflatable flotation bags 82 with a gas filled cannister 84 and a hose 86 connected from the cannister to each of the inflatables. Typically, each hose may be up to four feet in length and folded in place when packed. From one to five inflatables can be folded and packed into a valise, each with a fill hose connected to the gas cannister. One soft valise comprises a portable system that when deployed may support a pleasure boat up to about 32' in length. Depending on the overall weight or displacement of the vessel or vehicle to be supported, a number of soft valises can be placed aboard. For use in an emergency, the valises are removed from their storage locations, the top zippers opened, the inflatables removed and flaked in the direction of desired deployment. A lanyard 88 is pulled, releasing gas from the storage cannister which remains in the bottom of the valise. All bags will inflate within a minutes time.

Figure 8:
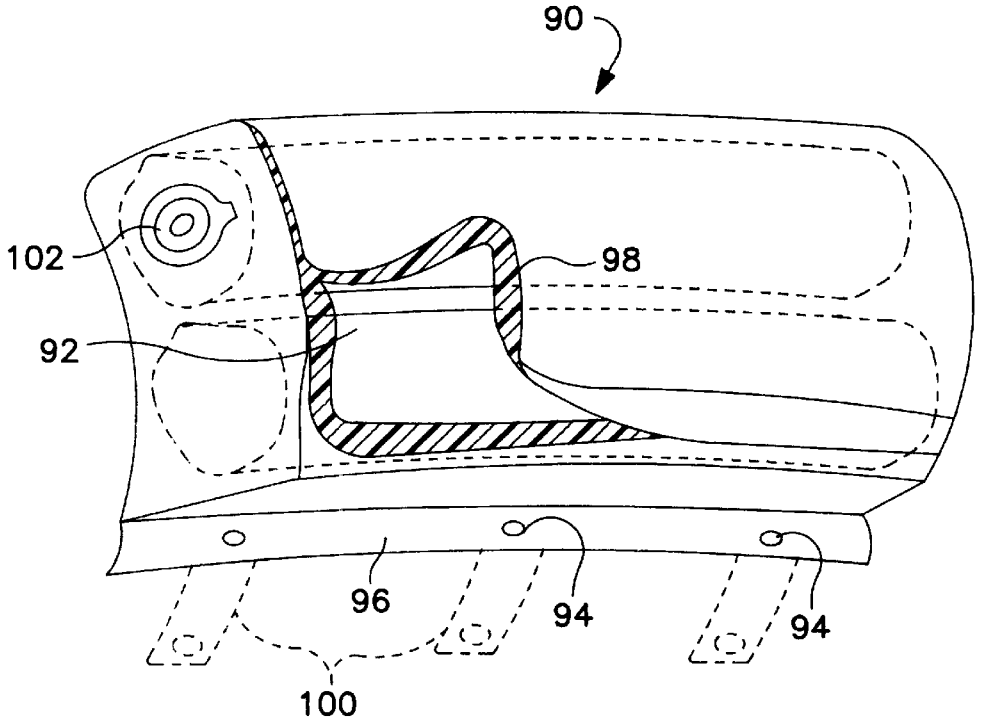
FIG. 8 illustrates a folded inflatable bag in a tight package inside a pouch enclosure.

An integral soft pouch enclosure 90 as shown in FIG. 8 comprises an engineered or custom installation specified according to the lift required to float or hold up a vessel or vehicle if submerged. Several pouches with inflatable bags 92 are distributed in the vessel for proper balance or trim and bolted at 94 into place along a securing tab 96.

Preferably each inflatable bag 92 includes a reinforced securing tab along with restraining straps or net previously described in connection with FIGS. 5 and 6. The inflatable bags 92 are folded and placed in the pouch so that the heavy reinforcing tab 96 and the tab of the pouch itself can be bolted as a unit to a structural member of the vessel or vehicle.

In a typical installation the pouches are delivered ready for installation with a typical pouch measuring 24"L×9"H×4"D. The pouch closure includes a hook and loop fastener 98 allowing the bag to burst forth from folded condition simply by activating the gas supply. The pouch is also fitted with a cutout in the rear panel for connection to the inlet check valve of the inflatable. The bag is folded in such manner and placed within the pouch so that the inlet valve registers with the pouch cutout.

An advantage of a custom system is that the inflatables are attached low down in the vessel or vehicle so the vessel floats higher in the water after deployment of the system.

In an alternate custom installation, each folded, inflatable bag is mounted in a durable, plastic pan fastened below the floor boards or bunk boards, thus hiding and protecting the inflatable bags. The bags are connected by suitable hoses to a gas supply.

A modification of the engineered system permits extension of web straps 100 or use of netting so that when the system inflates, the bag, which may with its pouch, be enclosed in a small tray below a floorboard can inflate just above the side of the tray and not be constrained, even though having been folded down to a short length to fit into the tray.

Another modification allows a pouch to contain a gas cannister of sufficient capacity to inflate just one bag contained therein. In this modification, the gas cannister may have a simple turn valve 102 or a lanyard for deployment.

The inlet valve featured in the inflatable devices of the invention is an inlet-check valve with inflation gas allowed to enter but not escape through the inlet after inflation. This feature is important in an emergency in case the fill hose becomes ruptured. The feature is also important if the hose is to be disconnected in switching to a back-up inflation system as in using a small gas compressor or electric air pump with fittings for connection to the inlet valve.

Another valve, the topping-off valve, is normally provided so that a manual pump can be connected from time to time to keep bags fully inflated. This is required in any inflatable system because no matter how well designed a system is, gradual weeping of air occurs.

The pressure relief valve is necessary because the pressures in gas supply cannisters can vary significantly with temperature change. Thus, in a flotation system deployed in the tropics, the gas may expand too rapidly and cause dangerous over inflation that must be rapidly relieved by the pressure relief valve. If a system is deployed in a polar region, under inflation can occur unless gas cannisters have a sufficient gas supply. Accordingly, inflation systems are designed with sufficient gas for complete inflation at low ambient temperature, and with a pressure relief valve to exhaust excessive gas pressure at high ambient temperature.

In the case of inflation devices designed for lifting submerged objects, where an object is to be lifted from deep water, the pressure in the lift bag can increase so rapidly that it will burst the bag unless the pressure is relieved.

In this regard, an alternative means for accommodating over-pressure is an oversize bag so that gas volume at differing ambient temperatures provides sufficient lift for a salvage application without ever reaching the burst pressure of the bag.

A suitable method for lifting submerged objects is to construct an inflatable bag with an open bottom, attaching the submerged load to a lift ring at the bottom of a harness holding the open bottom down, and within the open bottom allowing excess inflation gas to escape rapidly as the bag ascends bearing the submerged load.

FIG. 2 illustrates valves 40, 42, 44 which are typically inlet or inlet check, pressure relief, and topping off valves. The inlet or inlet check valve opening may have either male or female threads of various standard sizes for use with pressure hoses and gasses, including for use with standard automobile or truck tire valves In FIG. 1 alternative locations of inlet or inlet check, pressure relief, and topping-off valves 20*a–c* are shown. FIG. 5 illustrates another preferred location of inlet or inlet check, pressure relief, and topping-off valves 61,63,65.

In flotation devices for some applications additional pressure relief valves are mounted to provide sufficient dump capacity when inflating at a higher ambient temperature or in order to provide such capacity for faster return from below to the surface of the water. Some applications, as for example, when hand turn valves are used for inflation, may not require pressure relief, as long as the turn valve is monitored and shut off when the bag is inflated to design pressure. Similarly, topping-off or pressure relief valves may not be needed if the inlet valve is connected to a gas supply using a controllable compressor, as in a diving application, or in a truck air brake system or using the air from a large truck tire in the case of containment of leaks from a chemical delivery truck.

Each inflatable, after being bolted in place, is connected by hose to a gas cannister with a supply of gas for inflation. With a lanyard from the gas cannister led to a convenient location, the system is ready for deployment at a moments notice. Ordinarily, there is sufficient time for deployment before a vessel or vehicle sinks. Once the lanyard is pulled the entire system inflates in a minute or so.

Figure 9:
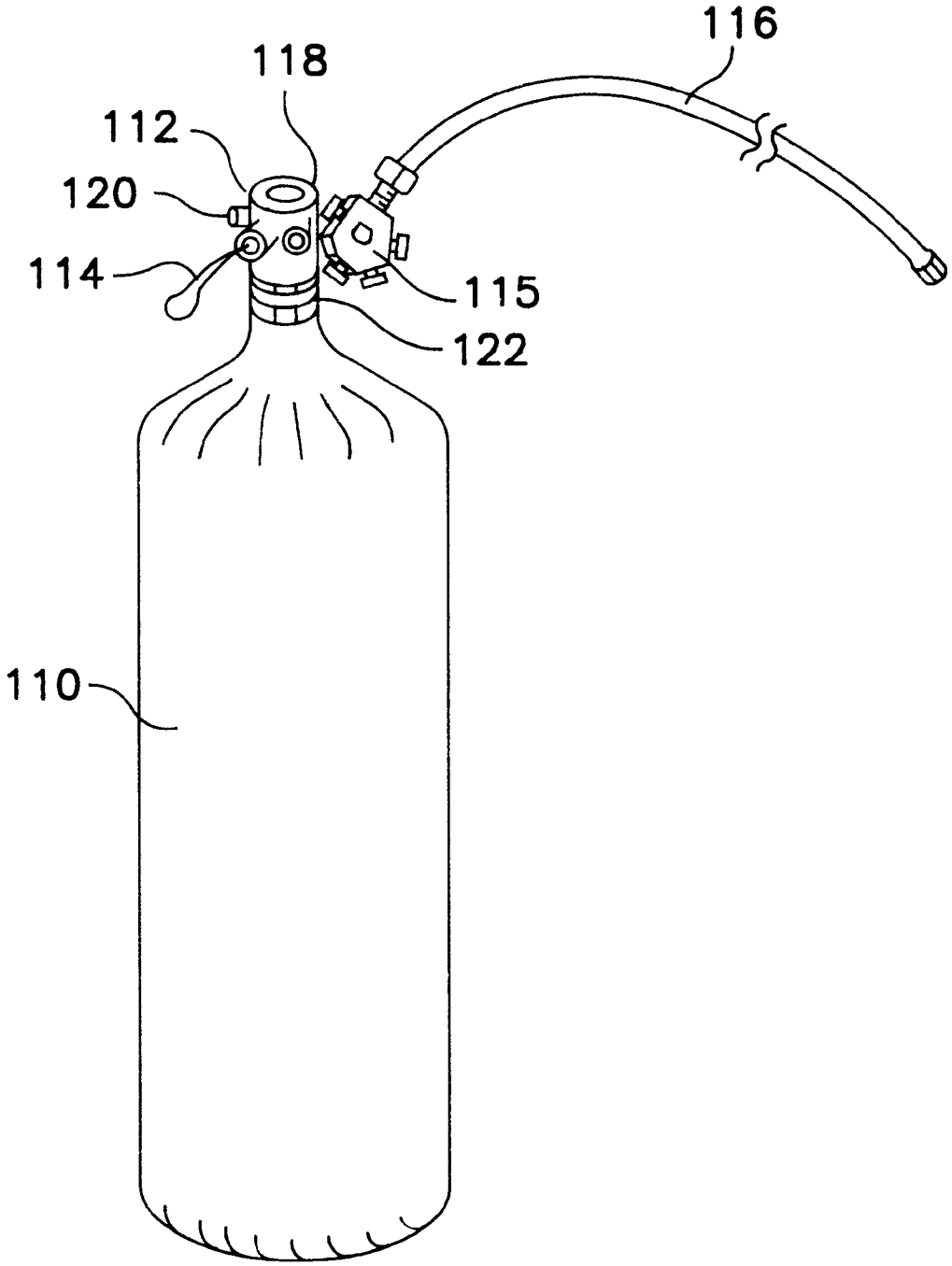
FIG. 9 illustrates a gas inflation cannister with inflation valve for filling inflatable bags.

FIG. 9 shows a typical gas cannister 110 together with its inflation valve 112. The inflation valve features a lanyard pull 114 which activates the valve so that gas is released to a manifold 115, to which is connected individual gas hoses 116 leading to the inflatable bags forming the flotation system. The gas cannister is sized to provide capacity to fill the number of inflatables in the system. The cannister design also is appropriate for the gas to be used, usually carbon dioxide, a combination of $CO_2$ and nitrogen, or air. A sufficient quantity of $CO_2$ normally requires only about half the volume as for air. Nonetheless, air may be more convenient if the user is a diver with scuba tanks, as for example where the inflatables are used for salvage. In addition, air may be specified as a back-up supply in some applications, in which case additional fittings must be arranged for both $CO_2$ and air. When $CO_2$ is used, some nitrogen can be added to extend the temperature range over which the gas will be of sufficient volume. Also, nitrogen is introduced at higher pressures which allows filling the inflatables more rapidly.

The inflation valve is normally provided with a fill stud 18 and separate pressure relief valve 120. The fill stud allows various methods to be used for filling the cannister with gas. The pressure relief valve provides a measure of safety in case of overfilling by pump or in case the cannister is exposed to too high an ambient temperature.

In one modification of the gas cannister and inflation valve, separate adapter fittings 122 are made to allow connection to a wider range of commercially available cannisters, or to allow the adapting of commercially available filled-and-sealed cannisters to different types of inflation valve actuators.

If desired, a pyrotechnic inflator or hybrid combination of a pyrotechnic inflator and gas cannister may be used for inflation.

The gas cannisters can be mounted in out-of-the-way places with a lanyard extending to reach the most convenient location for emergency deployment in vessel or vehicle.

Similarly, in an engineered system the hoses are made of sufficient length to reach all the installed inflatable bags. In some instances it may be found convenient to use "Y" connectors at some distance from the gas cannister. In these instances, it is necessary to provide balance of back pressures in the system, using different diameters of hose.

Inflation valves are normally fitted with a safety pin used to prevent inadvertent release with the safety pin removed before deployment.

In use, a quick pull on a lanyard of about 15 pounds will release gas to inflate a complete system in less than a minute where $CO_2$ is used and a fraction of a minute where high pressure air is used. If manual or electric air pumps are used inflation time will be substantially increased- to several minutes per bag.

The inflation system can be actuated by automatic means such as solid state or mechanical float switches with a small dedicated battery or house battery. The float switches actuate a pyrotechnic squib which expands in a small chamber to open the inflation valve. In a similar manner, a panic button can be rigged using a push button switch and the pyrotechnic charge described. In every case of automatic actuation, there is a back-up manual lanyard in case of failure of any aspect of the automatic system.

Figure 10:
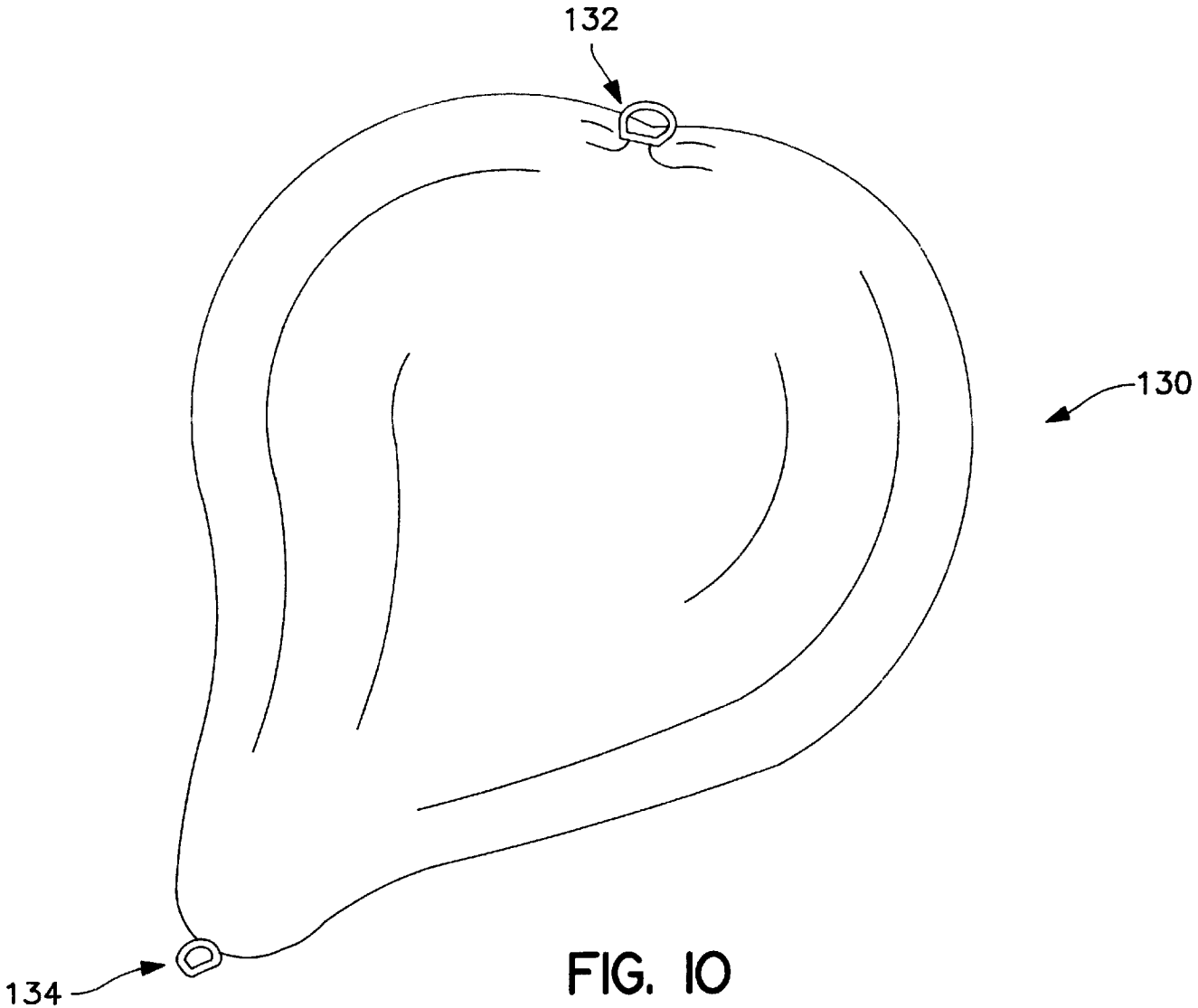
FIG. 10 illustrates a protective shroud for a flotation device.

In certain applications such as lift bags for salvage, it is necessary and desirable to keep debris, ropes, and cables from impinging directly of the inflatable bags. As an example, when a bag comes to the surface in the course of lifting a heavy object and must be towed for some distance before discharging the load, it is desirable to keep debris and seaweed from becoming entangled with the harness or bag. For this purpose, an external and integral shroud 130 (FIG. 10) may be furnished as a part of bag design. The shroud is constructed of smooth, woven elastic material, cut and sealed or sewn, to fit tightly about the inflatable and its harness. The shroud includes upper and lower 134 towing shackles.

For vehicles such as tracked vans travelling over a frozen lake, the inflatable systems of the invention are mounted to the lower side panels outside the vehicle so as not to consume interior space. Heavier weights of material such as ballistic cloth are used of sufficient strength to withstand crashing through ice. The types of vehicles travelling on ice includes all-terrain vehicles, larger tracked vans, and tracked grooming vehicles used on snowmobile trails which sometimes traverse nearby rivers and lakes.

The bags according to the invention are also used for spill containment of oil and chemicals. This application uses low weight and light bulk inflatables in a range of sizes, as for example an inflated round or rectangular tube supporting a central apron in which the spill is collected.

It is to be understood that flotation devices according to the invention are suitable for a variety of applications including deployment in marine vessels, lift bags for marine salvage, in all types of vehicles such as track vehicles, vans, snowmobiles, as well as for chemical and oil spill containment on land and on bodies of water.

Various changes may be made to the structure embodying the principles of the invention. The foregoing embodiments are set forth in an illustrative and not in a limiting sense. The scope of the invention is defined by the claims appended hereto.

I claim:

1. A method of forming an inflatable bag within a bag comprising the steps of:

a. forming an outer inflatable bag with defining walls and with a peripheral sealable edge with the edge partially sealed leaving an unsealed edge portion for access to the interior of the outer bag, b. forming an inner inflatable bag with defining walls and with a peripheral sealable edge with the edge partially sealed leaving an unsealed edge portion for access to the interior of the inner bag, c. folding and inserting the inner bag through the unsealed edge portion of the outer bag, and there, unfolding and spreading the inner bag, d. cutting aligned valve receiving openings through the defining walls of the outer and inner bags, e. inserting and sealing valves to gas tightness in the aligned openings, and f. sealing the unsealed edge portions of the inner and outer bags.

2. A flotation device comprising an inflatable bag having a single wall construction of outer layer of rip-stop fabric in weight ranging from 200 to 1000 denier, the fabric covered on its inner surface with a deposited layer of thermoplastic material, the bag having an integral reinforced edge of several layers of heavy duty material sealed together to form a heavy duty peripheral flange for fastening the bag to a boat, a plurality of straps extending across the bag and secured at opposite ends to the flange, at least one strap extending longitudinally of the bag and secured at its ends to the peripheral flange, the cross and peripheral straps defining a restraining mechanism for holding the inflatable bag in place in a boat, an inlet valve, a pressure relief valve, and a topping off valve all penetrating the wall for inflating the bag.

3. A flotation device as defined in claim 2 in which the peripheral flange is reinforced by a stiff metal bar.

4. A flotation device as defined in claim 2 in which the straps are sealed into the bag wall with thermoplastic material.

5. A flotation device as defined in claim 2 in which the cross and longitudinal straps cover the upper and lower sides of the bag.

6. A flotation device comprising an inflatable bag having a single wall construction of outer layer of rip-stop fabric in weight ranging from 200 to 1000 denier, the fabric covered on its inner surface with a deposited layer of thermoplastic material, the bag having an integral reinforced edge of several layers of heavy duty material sealed together to form a heavy duty peripheral flange for fastening the bag to a boat, a restraining net extending across the bag and secured at its margins to the flange, the net defining a restraining mechanism for holding the inflatable bag in place in a boat, an inlet valve, a pressure relief valve, and a topping off valve all penetrating the for inflating the bag.

7. A flotation device as defined in claim 6 in which the peripheral flange is reinforced by a stiff metal bar.

8. A flotation device as defined in claim 6 in which the net covers the upper and lower sides of the bag.

9. A flotation device as defined in claim 6 in which the net is sealed to the bag wall with thermoplastic material.

10. A flotation device comprising an inflatable bag fitted with a harness, the inflatable bag having a single wall construction of outer layer of rip-stop fabric in weight ranging from 200 to 1000 denier, the fabric covered on its inner surface with a deposited layer of thermoplastic material, the bag having an integral reinforced edge of several layers of heavy duty material sealed together to form a heavy tab for fastening the bag to a boat, an inlet valve, a pressure relief valve, a topping off valve all penetrating the single wall for inflating the bag, and a shroud fitting tightly about the inflatable bag and its harness, and the shroud fitted with at least one towing shackle.

11. A flotation device as defined in claim 10 in which the shroud comprises elastic material of a size to expand at the end of bag inflation.

12. A flotation device as defined in claim 11 in which the shroud comprises a strong net.

13. A method for deploying a flotation system within a marine vessel comprising the steps of:

(a) placing within a soft valise a gas canister together with a plurality of deflated, folded flotation bags each with a fill hose connected to the canister, (b) connecting a lanyard to the gas canister for releasing gas to the flotation bags, (c) closing an access opening in the valise, (d) placing the valise filled as in step (a) within a marine vessel, (e) in an emergency, (i) opening the valise, (ii) removing all flotation bags from the valise and flaking the bags in direction of desired deployment within the marine vessel, and (iii) pulling the lanyard to release gas from the canister to inflate each bag.

14. A method as defined in claim 13 which further includes the step of securing the valise to the marine vessel.

15. A flotation system comprising a soft pouch enclosure having a securing tab, a hook and loop fastener for opening and closing the pouch, at least one flotation bag folded in deflated condition and packed into the pouch, at least one inflatable bag having a reinforced securing tab, the pouch securing tab together with the bag reinforced securing tab adapted to be affixed to a structural member of a marine vessel, a gas filled canister in the pouch for inflating the bags, means for releasing gas from the canister to the inflatables so that the inflatable bag bursts forth from folded condition through the hook and loop fastener when inflated.

* * * * *